US011364600B2

(12) United States Patent
Chiang

(10) Patent No.: US 11,364,600 B2
(45) Date of Patent: Jun. 21, 2022

(54) RATCHET WRENCH

(71) Applicant: William Tools Co., Ltd., Taichung (TW)

(72) Inventor: Shui-Lai Chiang, Taichung (TW)

(73) Assignee: WILLIAM TOOLS CO., LTD., Taichung (TW)

( * ) Notice: Subject to any disclaimer, the term of this patent is extended or adjusted under 35 U.S.C. 154(b) by 13 days.

(21) Appl. No.: 16/923,546

(22) Filed: Jul. 8, 2020

(65) Prior Publication Data

US 2021/0060739 A1 Mar. 4, 2021

(30) Foreign Application Priority Data

Aug. 29, 2019 (TW) ..... 108131110

(51) Int. Cl.
*B25B 13/46* (2006.01)
*B25B 23/00* (2006.01)

(52) U.S. Cl.
CPC ..... *B25B 13/463* (2013.01); *B25B 23/0035* (2013.01)

(58) Field of Classification Search
CPC ..... B25B 13/463; B25B 23/0035
See application file for complete search history.

(56) References Cited

U.S. PATENT DOCUMENTS 1,177,764 A * 4/1916 Dodge ..... B25B 13/463 81/62
2,590,387 A * 3/1952 Dodge ..... B25B 13/463 81/62
4,218,940 A * 8/1980 Main ..... B25B 13/06 81/177.85
4,254,675 A * 3/1981 Marlow ..... B25B 13/463 81/63
4,274,311 A * 6/1981 Ebert ..... B25B 13/463 192/43.1
4,308,769 A * 1/1982 Rantanen ..... B25B 13/463 81/63
4,419,911 A * 12/1983 Claudy ..... B25B 13/468 81/62
5,582,080 A * 12/1996 Barmore ..... B25B 13/463 81/177.85
6,948,405 B1 * 9/2005 Simmons ..... B25B 13/463 81/62
2010/0132517 A1 * 6/2010 Crawford ..... B25B 13/461 81/63
2012/0118113 A1 * 5/2012 Wu ..... B25B 13/56 81/63.1

FOREIGN PATENT DOCUMENTS

CN 106392967 A 2/2017
CN 208068129 U 11/2018
CN 208304886 U 1/2019
(Continued)

*Primary Examiner* — Bryan R Muller

(74) *Attorney, Agent, or Firm* — Muncy, Geissler, Olds & Lowe, P.C.

(57) ABSTRACT

A ratchet wrench is provided, including a main body unit, a ratchet mechanism and a control assembly. The main body unit includes a head portion and a handle portion which is connected to the head portion. The ratchet mechanism is disposed on the head portion, and the control assembly is disposed on the handle portion.

7 Claims, 11 Drawing Sheets

(56) References Cited

FOREIGN PATENT DOCUMENTS

| | | | |
|---|---|---|---|
| CN | 208977685 | U | 6/2019 |
| TW | I632028 | B | 8/2018 |
| TW | M566644 | U | 9/2018 |
| TW | M572287 | U | 1/2019 |
| TW | I652147 | B | 3/2019 |
| TW | M576088 | U | 4/2019 |
| TW | I661909 | B | 6/2019 |

* cited by examiner

RATCHET WRENCH

BACKGROUND OF THE INVENTION

Field of the Invention

The present invention relates to a ratchet wrench.

Description of the Prior Art

A traditional box wrench can be used to tighten or loosen a screw or a bolt, but it requires a greater space for this type of box wrench to rotate. If the space is limited, a user can only rotate the box wrench for an angle, so the user needs to sleeve the box wrench onto and off repeatedly. This is troublesome. Therefore, the industry developed a ratchet wrench which includes a ratchet mechanism into a wrench main body, so the user can swing the ratchet wrench back and forth in a small angle to tighten or loosen the bolt, and s/he does not need to take the ratchet wrench down and sleeve it onto the bolt repeatedly. This type of ratchet wrenches are disclosed in TWI661909, TWI652147, TWI632028, TWM572287, TWM576088 and TWM566644 or CN208977685, CN106392967, CN208304886 and CN208068129.

However, the structure of the above-mentioned ratchet wrench has already been a set pattern for the industry, and few people keep studying and improving the structure of the ratchet wrench, so there are no innovative and unique structures on the market recently, and problems like complex structure, processing difficulty and low assembling efficiency still exist.

The present invention has arisen to mitigate and/or obviate the afore-described disadvantages.

SUMMARY OF THE INVENTION

The major object of the present invention is to provide a ratchet wrench, a control assembly which controls the pawl unit to move to be meshed with the ratchet main body is disposed on the handle portion, so the control assembly is closer to a hand of a user, and the user can quickly adjust and switch a rotation direction. More importantly, when a head portion enters a narrow space, a handle portion and the control assembly are exposed outside, so the user can switch the rotation direction directly from outside without pulling the ratchet wrench off. In addition, with this structure design, when user wants to disassemble a socket on the head portion, s/he would naturally grip the handle portion with one hand and grip the socket with the other hand, so s/he can make sure the socket will not fall off and cause harm.

To achieve the above and other objects, a ratchet wrench is provided, including a main body unit, a ratchet mechanism and a control assembly. The main body unit includes a head portion and a handle portion which is connected to the head portion; the ratchet mechanism includes a ratchet main body and a pawl unit, the ratchet main body is rotatably received and positioned within the head portion on an axis, and the pawl unit is movably received within the head portion and meshable with the ratchet main body; the control assembly is movably disposed in the handle portion, a part of the control assembly projects within an interior of the head portion to move the pawl unit, the control assembly is operable from outside to rotate relative to the handle portion to be on a first position, a second position or a third position, the control assembly includes an shaft, a driving member and a switch member which are in a co-movement relationship, the shaft is received within the handle portion, the shaft includes a first end and a second end which is opposite to the first end, the first end is closer to the head portion relative to the second end, the driving member is disposed on the first end, the switch member is disposed on the second end, the driving member projects into the head portion to drive the pawl unit, and the switch member is for being operated and rotated from outside; when the control assembly is on the first position, the control assembly controls the pawl unit to be only meshed with one of two sides of the ratchet main body so that the ratchet main body only rotates in a rotation direction; when the control assembly is on the second position, the control assembly controls the pawl unit to be meshed with the other of the two sides of the ratchet main body to make the ratchet main body to rotate in a direction opposite to the rotation direction; when the control assembly is on the third position, the control assembly controls the pawl unit to be meshed with the two sides of the ratchet main body opposite to each other so that the ratchet main body is non-rotatable; the control assembly is movable toward or away from the head portion on an extension direction of the handle portion, the ratchet mechanism further includes a driving head and a quick release unit, the driving head is co-rotatably disposed on the ratchet main body, the driving head is for being inserted into a socket, the quick release unit includes a pushing member and a linkage assembly, the pushing member is movably disposed between the driving member and the linkage assembly, the linkage assembly is disposed through the driving head and movable between a releasing position and a positioning position, the linkage assembly is normally on the positioning position for engagement with the socket, when the linkage assembly is on the releasing position, the linkage assembly is non-engaged with the socket, and when the control assembly moves toward the head portion, the driving member moves toward the ratchet main body to push the pushing member to move, and the pushing member actuates the linkage assembly to move from the positioning position to the releasing position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
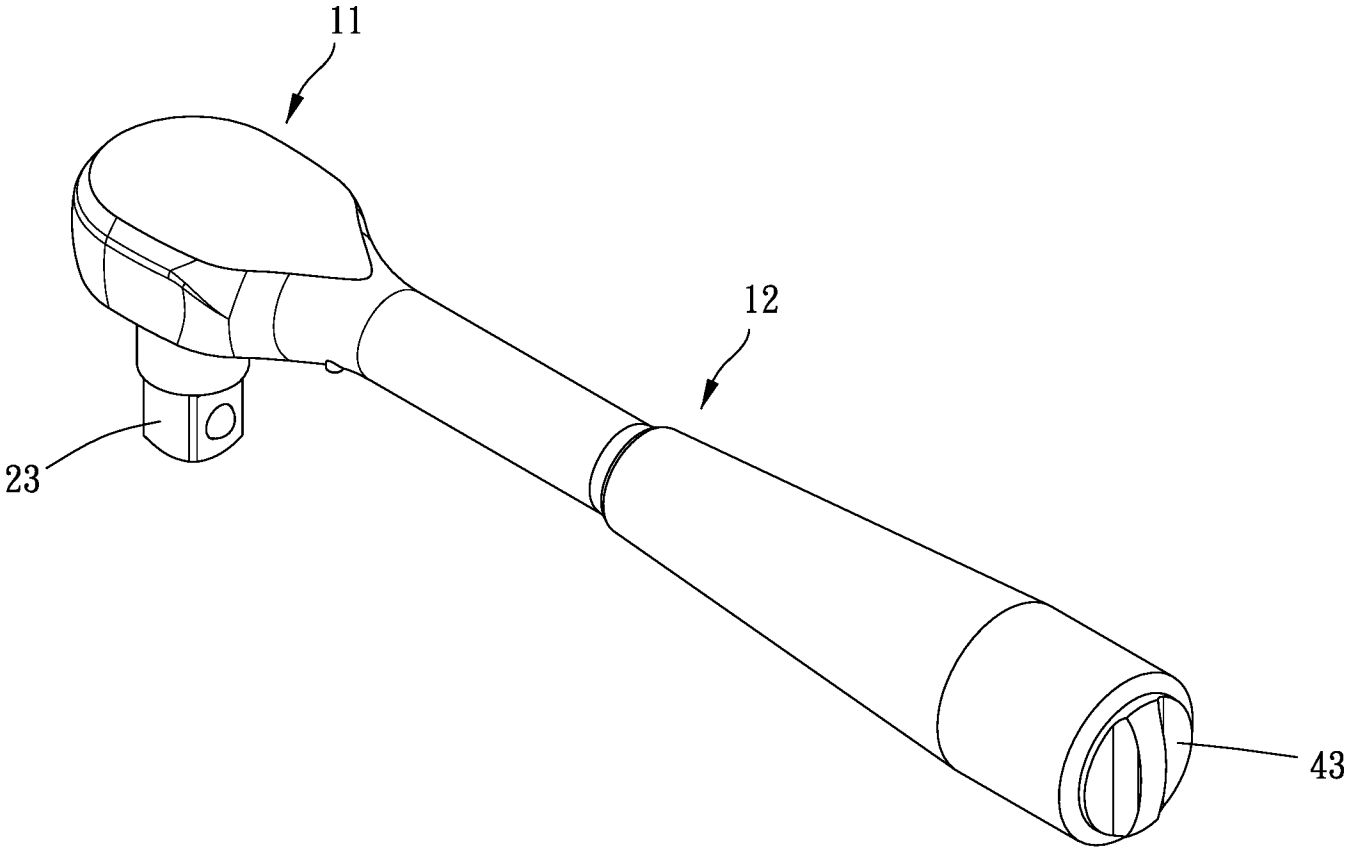
FIG. 1 is a stereogram of an embodiment of the present invention.
Figure 2:
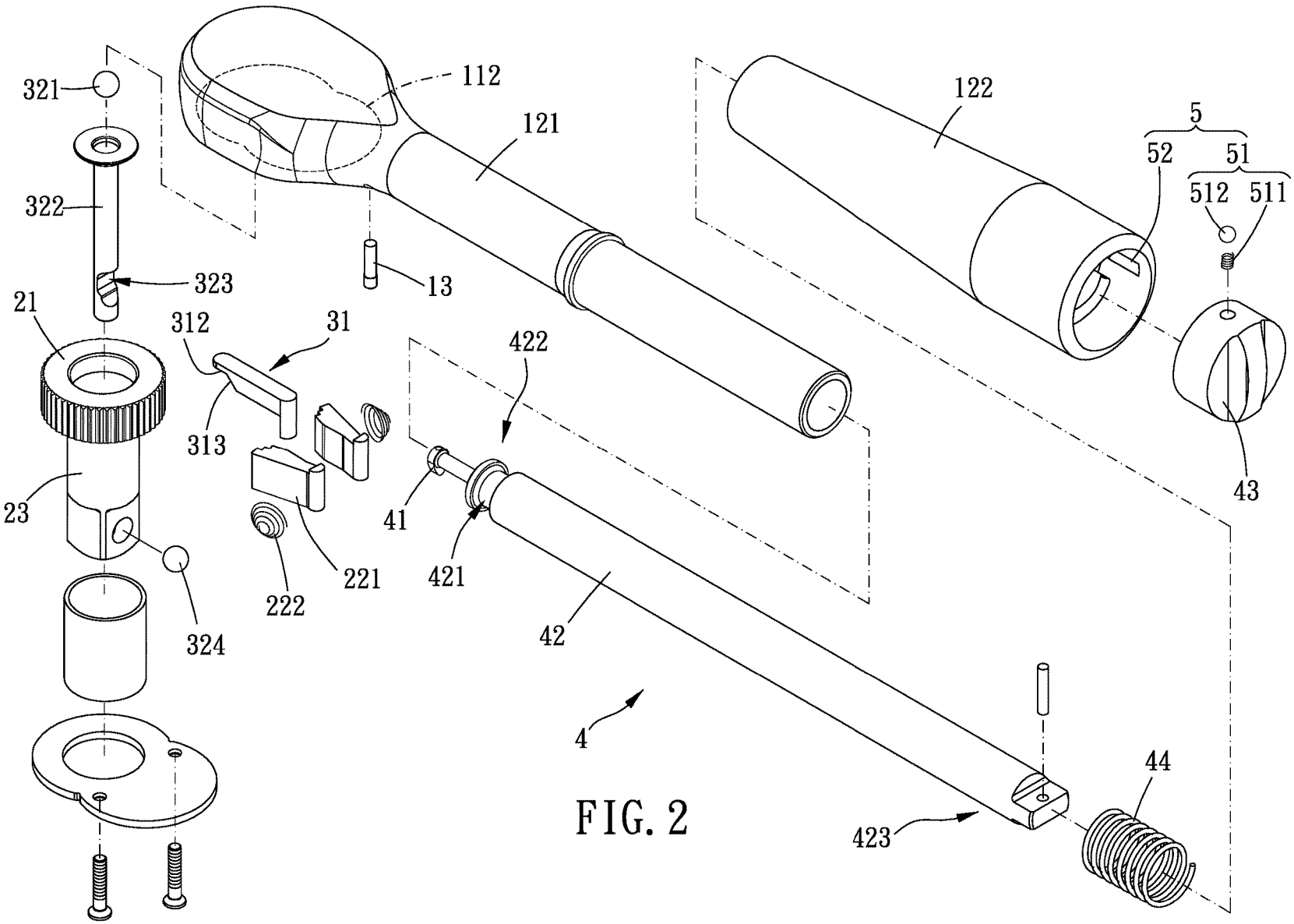
FIG. 2 is a breakdown view of FIG. 1.
Figure 3:
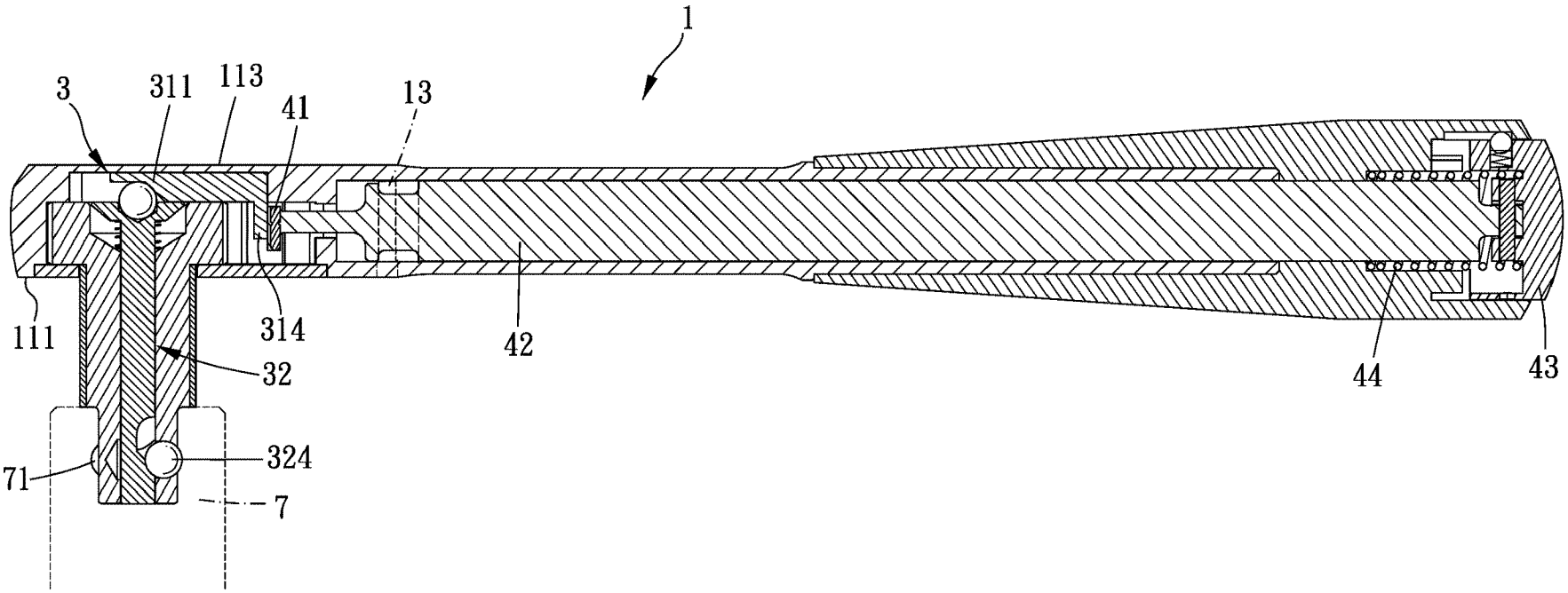
FIG. 3 is a cross-sectional view showing a ratchet wrench assembled to a socket of the embodiment of the present invention.
Figure 4:
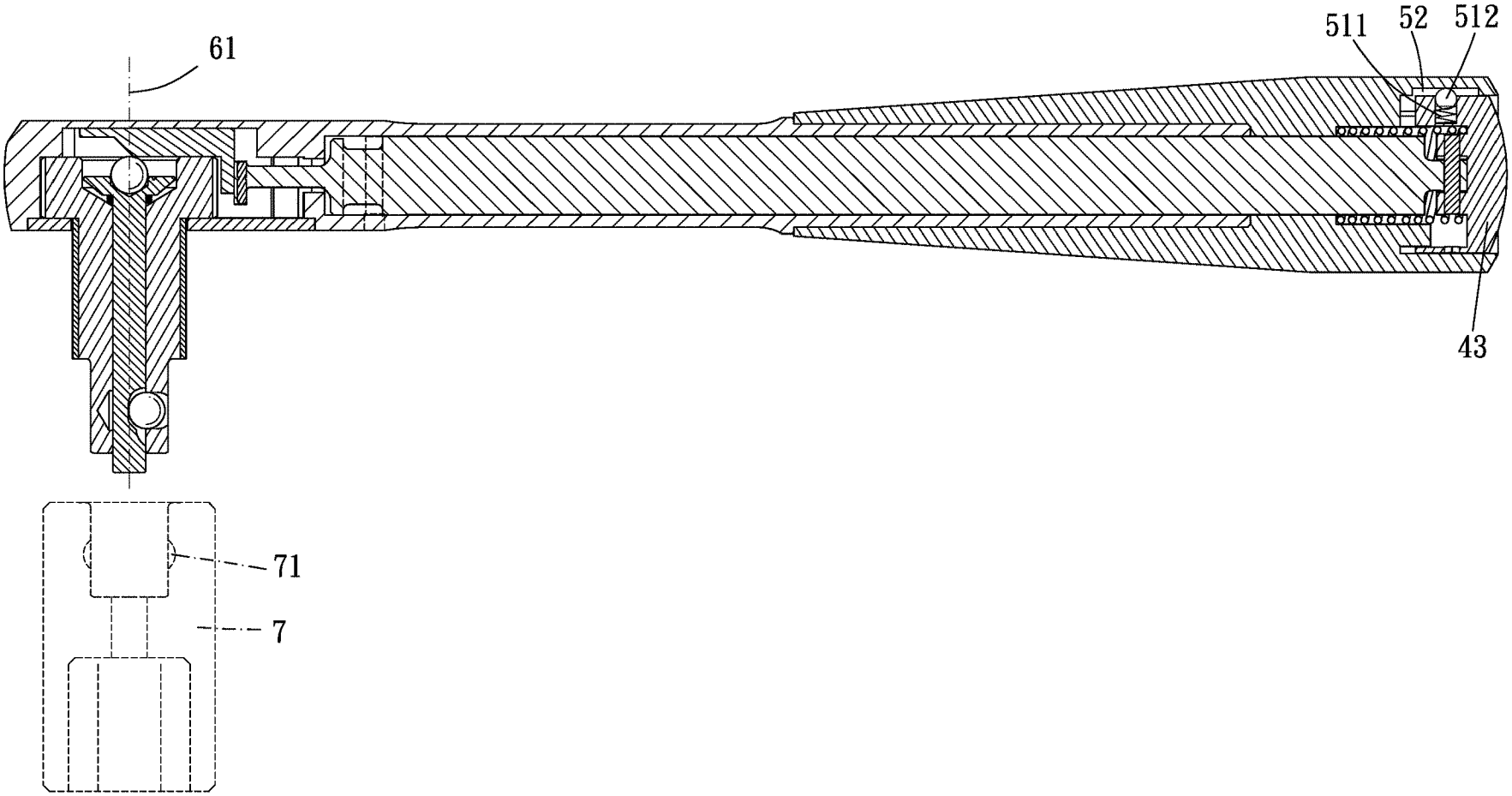
FIG. 4 is a cross-sectional view showing the ratchet wrench releasing the socket of the embodiment of the present invention.
Figure 5:
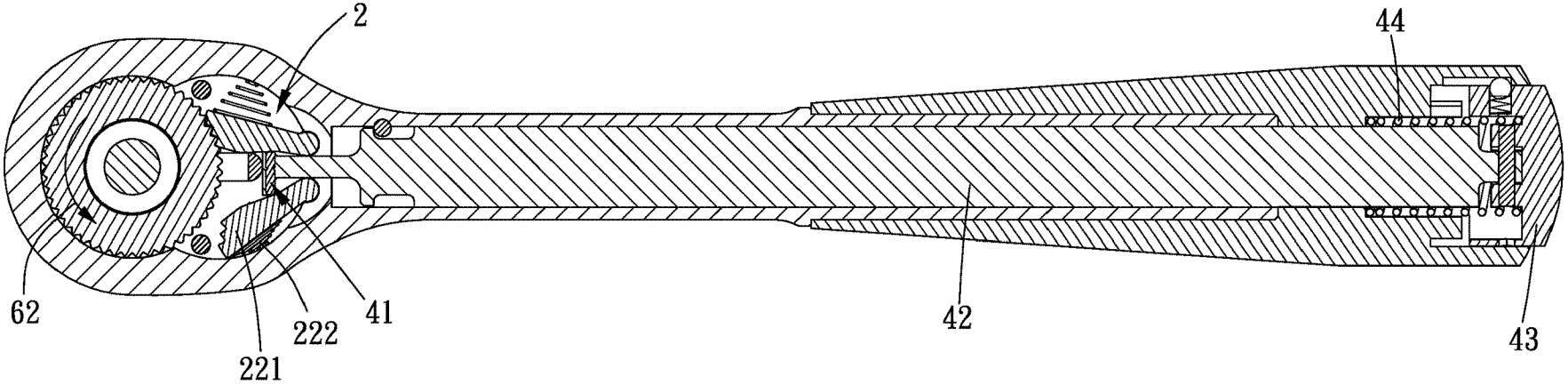
FIG. 5 is a cross-sectional view showing the ratchet wrench on a first position of the embodiment of the present invention.
Figure 6:
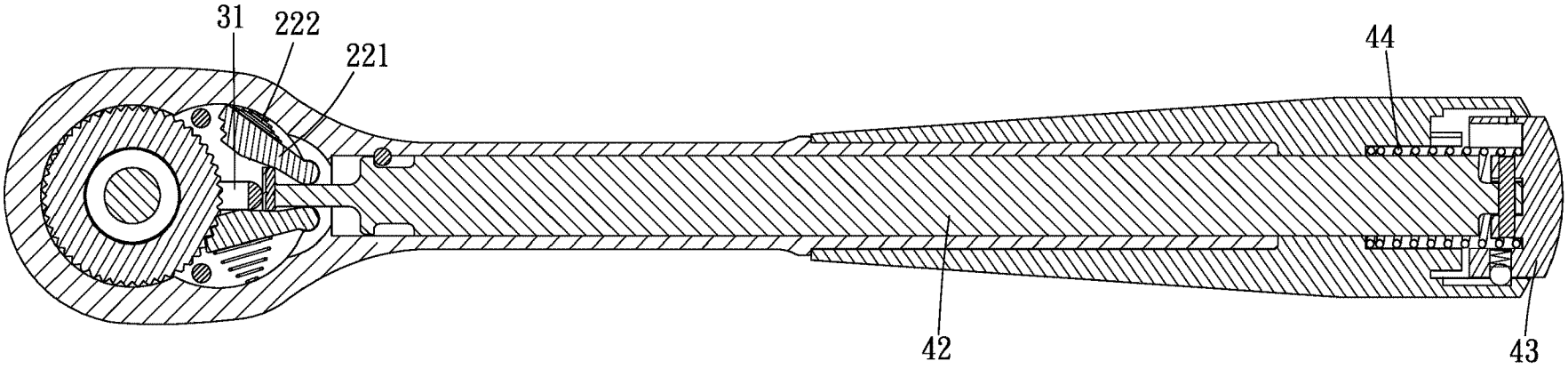
FIG. 6 is a cross-sectional view showing the ratchet wrench on a second position of the embodiment of the present invention.
Figure 7:
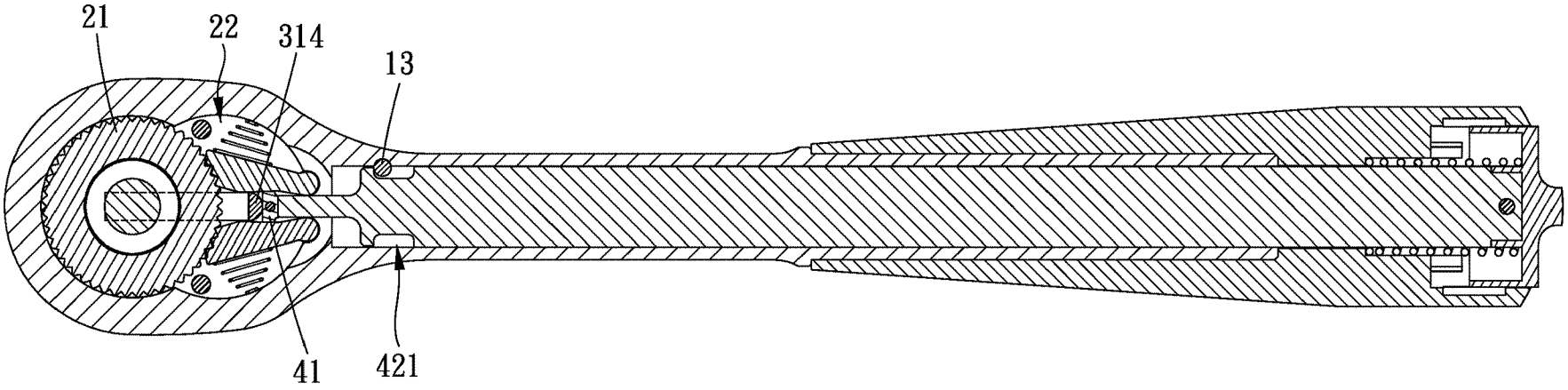
FIG. 7 is a cross-sectional view showing the ratchet wrench on a third position of the embodiment of the present invention.
Figure 9:
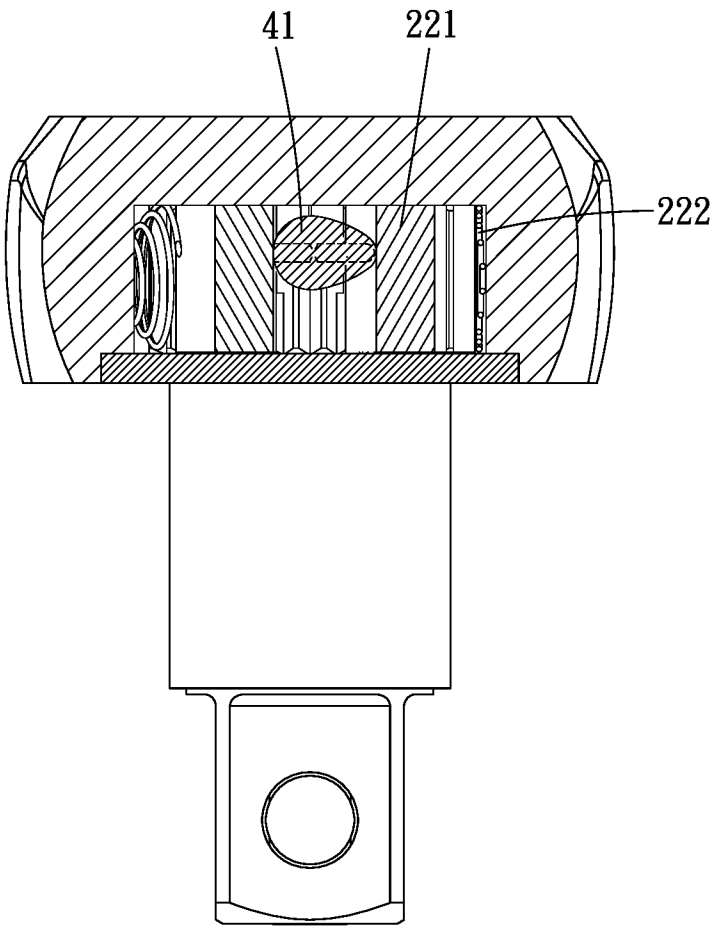
FIG. 9 is a drawing showing one of the two claws driven by the driving member of the embodiment of the present invention.
Figure 8:
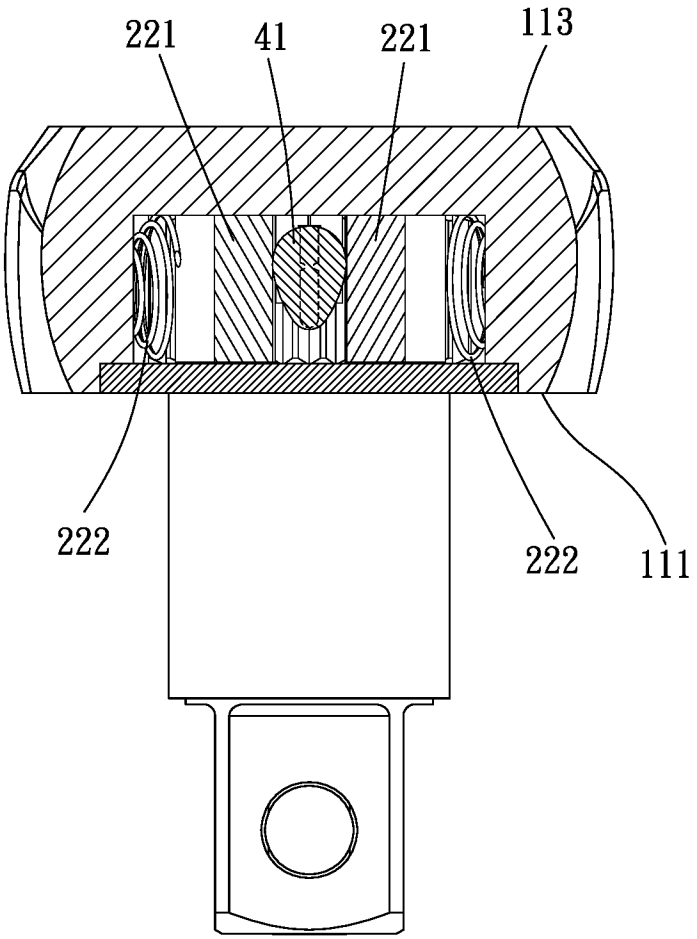
FIG. 8 is a drawing showing two claws non-driven by a driving member of the embodiment of the present invention.
Figure 10:
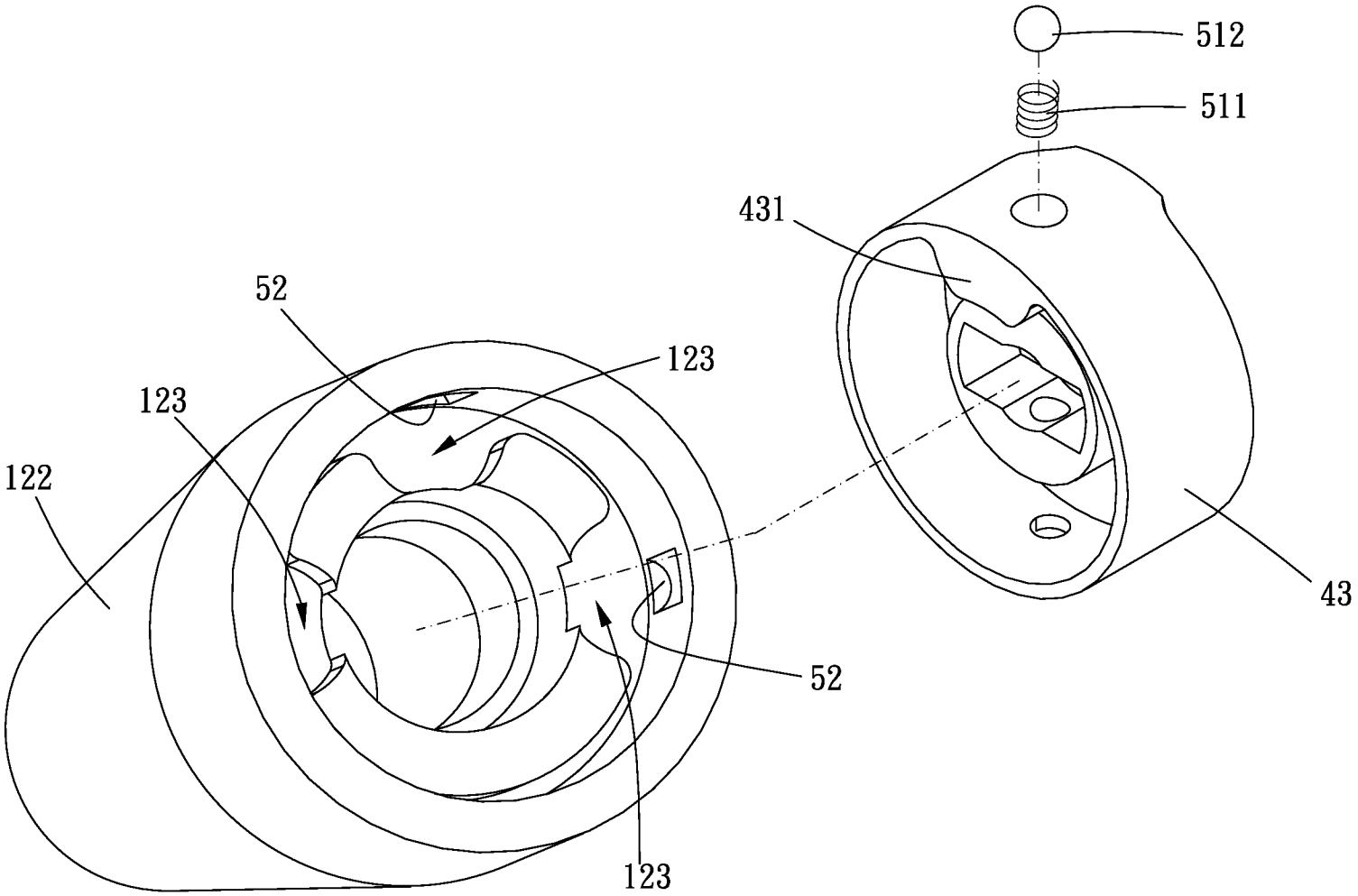
FIG. 10 is an enlarged stereogram of a second component and a switch member of the embodiment of the present invention.
Figure 11:
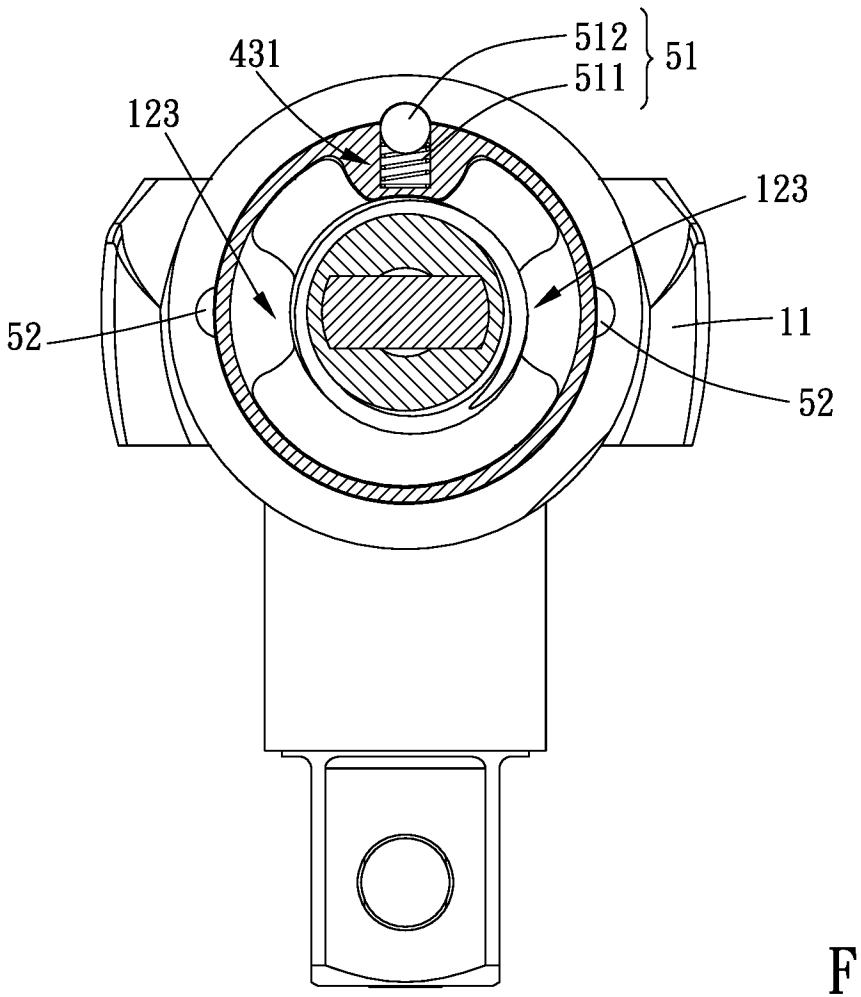
FIGS. 11 and 12 are drawings showing the switching member of the embodiment of the present invention being rotated and positioned relatively.
Figure 12:
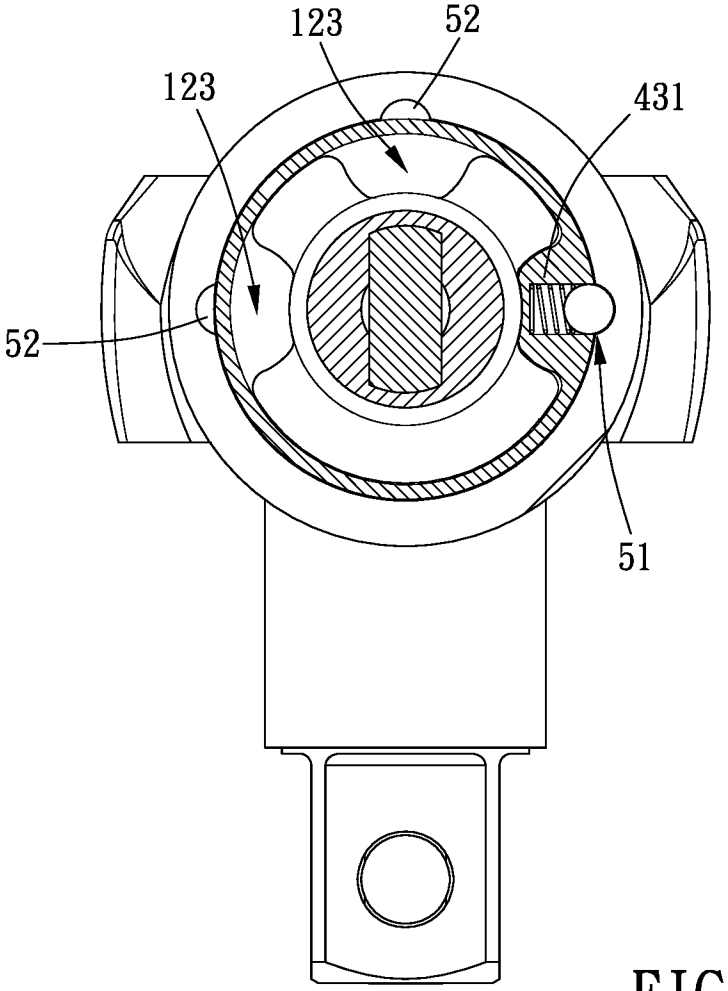

Please refer to FIGS. 1 to 12 for an embodiment of the present invention. A ratchet wrench includes a main body unit 1, a ratchet mechanism 2 and a control assembly 4.

The main body unit 1 includes a head portion 11 and a handle portion 12 which is connected to the head portion 11. The ratchet mechanism 2 includes a ratchet main body 21 and a pawl unit 22, the ratchet main body 21 is rotatably received and positioned within the head portion 11 on an axis 61, and the pawl unit 22 is movably received within the head portion 11 and meshable with the ratchet main body 21. The control assembly 4 is movably disposed in the handle portion 12, a part of the control assembly 4 projects within an interior of the head portion 11 to move the pawl unit 22, and the control assembly 4 is operable from outside to move to be on a first position, a second position or a third position.

When the control assembly 4 is on the first position, the control assembly 4 controls the pawl unit 22 to be only meshed with one of two sides of the ratchet main body 21 so that the ratchet main body 21 only rotates in a rotation direction 62; when the control assembly 4 is on the second position, the control assembly 4 controls the pawl unit 22 to be meshed with the other of the two sides of the ratchet main body 21 to make the ratchet main body 21 to rotate in a direction opposite to the rotation direction 62; when the control assembly 4 is on the third position, the control assembly 4 controls the pawl unit 22 to be meshed with the two sides of the ratchet main body 21 opposite to each other so that the ratchet main body 21 is non-rotatable.

The control assembly 4 is disposed in the handle portion 12, so an interior space of the handle portion 12 can be efficiently used, and an interior space of the head portion 11 can be released. Therefore, the interior space of the head portion 11 increased to ensure an interior component in the head portion 11 have more space to move, and some part of the interior component can even be enlarged to be stronger in accordance to different requirements. In addition, preventing components from overly concentrating in the head portion 11, a weight of the head portion 11 can be decreased, and the weight distribution of the ratchet wrench is more even. The control assembly 4 which is disposed in the handle portion 12 is closer to a hand of a user, so the user can quickly switch direction, the control assembly 4 can be farther from an operation environment (the head portion 11) where the ratchet wrench actually drives a fastener, and the control assembly 4 can maintain a complete structure without easily colliding with other objects.

Importantly, when the head portion 11 enters a narrow space, a handle portion 12 and the control is exposed outside, so the user can easily control the control assembly 4 to switch a rotation direction. In other words, it is easy and convenient to operate the ratchet wrench.

In addition, this type of arrangement can simplify the processing procedure can and lower the assembling difficulty. Specifically, the head portion 11 includes a first face 111 and a second face 113 which is opposite to the first face 111, when manufacturing the head portion 11, a manufacturer only has to open an input opening 112 on the first face 111, and then the ratchet mechanism 2 can enter the interior of the head portion 11 through the input opening 112, and there is no need to process, drill holes or assemble tiny components on the second face 113. In other words, the second face 113 is a structure which has an intact surface, in addition to elevate the whole appearance quality, the second face 113 can have greater structure strength to resist exterior impact. In addition, the control assembly 4 can be assembled in the handle portion 12 which is spacious instead of the head portion 11 which is narrow, and the component of the control assembly 4 may be in a greater volume for being manufactured or grasped conveniently.

In this embodiment, the control assembly 4 is operable from outside to rotate relative to the handle portion 12 to move to be on a first position, a second position or a third position, more specifically, the control assembly 4 includes an shaft 42, a driving member 41 and a switch member 43 which are in a co-movement relationship, the shaft 42 is received within the handle portion 12, the shaft 42 includes a first end 422 and a second end 423 which is opposite to the first end 422, the first end 422 is closer to the head portion 11 relative to the second end 423, the driving member 41 is disposed on the first end 422, the switch member 43 is disposed on the second end 423, the driving member 41 projects into the head portion 11 to drive the pawl unit 22, and the switch member 43 is for being operated and rotated from outside.

More specifically, the pawl unit 22 includes two claws 221 and two second elastic members 222, one of two ends of each said claw 221 is rotatably connected to the head portion 11, the other of the two ends of each said claw 221 is meshable with the ratchet main body 21, each of two ends of each said second elastic member 222 respectively abuts against and between one said claw 221 and the head portion 11, and the two second elastic members 222 enable the two claws 221 to have a tendency to move toward each other to be meshed with the ratchet main body 21. The shaft 42, the driving member 41 and the switch member 43 are coaxially arranged, and the driving member 41 is cam-shaped and disposed between the two claws 221.

Preferably, the shaft 42 is made of a hard material which is not deformable, the switch member 43 and the driving member 41 are respectively detachably assembled to the shaft 42, when some components are abraded to a certain extent, the user only needs to replace the components which are abraded without replacing the whole control assembly 4.

More preferably, the ratchet wrench further includes a positioning mechanism 5, the positioning mechanism 5 includes an engaging assembly 51 and three recesses 52, the three recesses 52 respectively corresponding to the first, second and third positions, and the engaging assembly 51 is configured to be embedded within one of the three recesses 52 on a lateral direction of the handle portion 12 to stably keep the control assembly 4 on a position. The engaging assembly 51 is disposed on one of the switch member 43 and the handle portion 12, and the three recesses 52 are disposed on the other of the switch member 43 and the handle portion 12.

In this embodiment, the three recesses 52 are disposed on the handle portion 12 in equal angle, the engaging assembly 51 is disposed on the switch member 43, the engaging assembly 51 includes a third elastic member 511 and a restricting ball 512, the third elastic member 511 is radially engaged with the switch member 43, the restricting ball 512 is arranged on one of two ends of the third elastic member 511, and the restricting ball 512 is pushed by the third elastic member 511 to radially press the handle portion 12 normally so as to be embedded within one of the three recesses 52.

It is to be noted that aside from being rotatable relative to the handle portion 12, the control assembly 4 can move close to or away from the head portion 11 along the extension direction of the handle portion 12.

The ratchet mechanism 2 further includes a driving head 23 and a quick release unit 3, the driving head 23 is co-rotatably disposed on the ratchet main body 21, the driving head 23 is for being inserted into a socket 7, the quick release unit 3 includes a pushing member 31 and a linkage assembly 32, the pushing member 31 is movably disposed between the driving member 41 and the linkage assembly 32, the linkage assembly 32 is disposed through the driving head 23 and movable between a releasing position and a positioning position, the linkage assembly 32 is normally on the positioning position for engagement with the socket 7, and when the linkage assembly 32 is on the releasing position, the linkage assembly 32 is non-engaged with the socket 7. When the control assembly 4 moves toward the head portion 11, the driving member 41 moves toward the ratchet main body 21 to push the pushing member 31 to move, and the pushing member 31 actuates the linkage assembly 32 to move from the positioning position to the releasing position; in other words, the user can quickly disassemble the socket 7 from the driving head 23 by pressing the control assembly 4.

In addition, the control assembly 4 is disposed on the handle portion 12, so when the user wants to release the socket 4, s/he has to grip on the handle portion 12 with one hand and the socket 7 with the other hand so as to make sure that the socket 7 is firmly held during the disassembling process, and the socket 7 will not fall easily to hurt the user himself/herself or other people.

When the control assembly 4 rotates relative to the handle portion 12, the ratchet main body 21 can be controlled to rotate in three directions (clockwise, counterclockwise and non-rotated), and when the control assembly 4 moves relative to the head portion 11 relative to the handle portion 12, the socket 7 can be quickly released or assembled; that is, the control assembly 4 can function in various ways through rotation and movement, and the user only needs to control the control assembly 4 (the switch member 4) to meet different requirements.

Specifically, the linkage assembly 32 includes a roller 321, a linkage 322 and a positioning ball 324 which are arranged along the axis 61, the roller 321 is positioned on one of two ends of the linkage 322, the other end of the two ends of the linkage 322 has a receiving slot 323, and the positioning ball 324 is movably received in the receiving slot 323 and projectable beyond the driving head 23 to be embedded into a positioning hole 71 of the socket 7. The pushing member 31 includes a pushing portion 311 and a pushed portion 314, one of two ends of the pushing portion 311 is laterally connected to the pushed portion 314, the other of the two ends of the pushing portion 311 includes a linear section 312 and an inclined section 313, and the pushed portion 314 is between the ratchet main body 21 and the driving member 41. When the linkage assembly 32 is on the positioning position, the roller 321 is sandwiched between the linear section 312 and the linkage 322, the inclined section 313 laterally abuts against the roller 321, and the positioning ball 324 projects beyond the driving head 23; when the pushing member 31 is pushed by the driving member 41 to move, the inclined section 313 presses the roller 321, the roller 321 slides downward along a surface of the inclined section 313, when the roller 321 is relatively below the pushing portion 311, the positioning ball 324 is non-projected beyond the driving head 23, the linkage assembly 32 is on the releasing position completely, and the socket 7 can be taken off from the driving head 23.

More specifically, the shaft 42 has a circumferential slot 421, a positioning pin 13 is positioned on the handle portion 12 and penetrates through a side of the circumferential slot 421, the shaft 42 is rotatable relative to the positioning pin 13, and the shaft 42 is moveable relative to the positioning pin 13 along the handle portion 12; on the extension direction of the handle portion 12, the positioning pin 13 interferes with a side wall of the circumferential slot 421 to restrict the shaft 42 from moving relative to the handle portion 12 so as to effectively prevent the driving member 41 from overly pushing the pushing member 31 and damage a toothed portion of the ratchet main body 21, or to effectively restrict the shaft 41 within the handle portion 12 to prevent the shaft 42 from moving overly and falling out of the handle portion 12.

Preferably, the ratchet wrench further includes a first elastic member 44, one of two ends of the first elastic member 44 abuts against the main body unit 1, the other of the two ends of the first elastic member 44 abuts against the control assembly 4 to bias the control assembly 4 to move away from the head portion 11 so that the control assembly 4 can return to an initial position, the control assembly 4 can be made sure not easily moved by an unexpected force, the driving member 41 is normally non-abutted against the pushing member 31, and the linkage assembly 32 is on the positioning position normally to protect the user. In this embodiment, the first elastic member 44 is sleeved on the shaft 42 to prevent from being distorted and deformed during the pressing and extending process.

More preferably, on the extension direction of the handle portion 12, one of the handle portion 12 and the switch member 43 has an embedding portion 431, the other of the handle portion 12 and the switch member 43 has three rabbets 123, and the three rabbets 123 respectively correspond to the first, second and third positions; when the control assembly 4 moves toward the head portion 11 on the extension direction of the handle portion 12, the embedding portion 431 is embedded within one of the three rabbets 123, and the control assembly 4 is non-rotatable relative to the handle portion 12. In other words, to press the control assembly 4 to move toward the head portion 11, the user has to rotate exactly to one of the first, second and third positions. This is a safety mechanism, to prevent unexpected interference of the components by separating rotating action and moving action. In other embodiments, the switch member 43 has the embedding portion 431, and the handle portion 12 has the three rabbets 123.

Finally, to be more specific about a structure of the handle portion 12, the handle portion 12 includes a first component 121 and a second component 122, the first component 121 and the head portion 11 are integrally formed, and the second component 122 covers at least one part of the first component 121. The first component 121 and the head portion 11 are main frameworks of the ratchet wrench, and the first component 121 and the head portion 11 are preferably made of metal to be stronger and durable; the second component 122 is for grasping and is preferably made of plastic to provide more comfort.

In this embodiment, the second component 122 has the three rabbets 123 and the three recesses 52 which communicate with each other, so the second component 122 can be quickly manufactured through plastic injection molding. The three rabbets 123 respectively correspond to the three recesses 52, and the three recesses 52 respectively extend toward the head portion 11 along the extension direction of the handle portion 12 to allow the restricting ball 512 of the engaging assembling 51 to slide.

Given the above, after the control assembly is disposed on the handle portion, the ratchet wrench is convenient to use, when the head portion enters a narrow space, the handle portion is exposed outside, so the user can easily control the control assembly to switch the rotation direction without pulling the ratchet wrench out of the narrow space. In addition, with this type of structure, the user would naturally grip the handle portion with one hand and grip the socket with the other hand, so s/he can make sure the socket is firmly gripped on and will not fall off and cause harm.

While we have shown and described various embodiments in accordance with the present invention, it should be clear to those skilled in the art that further embodiments may be made without departing from the scope of the present invention.

What is claimed is:

1. A ratchet wrench, including:

a main body unit, including a head portion and a handle portion which is connected to the head portion;

a ratchet mechanism, including a ratchet main body and a pawl unit, the ratchet main body being rotatably received and positioned within the head portion on an axis, the pawl unit being movably received within the head portion and meshable with the ratchet main body;

a control assembly, movably disposed in the handle portion, a part of the control assembly projecting within an interior of the head portion to move the pawl unit, the control assembly being operable from outside to rotate relative to the handle portion to be in a first position, a second position or a third position, the control assembly including a shaft, a driving member and a switch member which are in a co-movement relationship, the shaft being received within the handle portion, the shaft including a first end and a second end which is opposite to the first end, the first end being closer to the head portion relative to the second end, the driving member being disposed on the first end, the switch member being disposed on the second end, the driving member projecting within the head portion to drive the pawl unit, the switch member for being operated and rotated from outside;

wherein when the control assembly is in the first position, the control assembly controls the pawl unit to be only meshed with one of two sides of the ratchet main body so that the ratchet main body only rotates in a rotation direction; when the control assembly is in the second position, the control assembly controls the pawl unit to be meshed with the other of the two sides of the ratchet main body to allow the ratchet main body to rotate in a direction opposite to the rotation direction; when the control assembly is in the third position, the control assembly controls the pawl unit to be meshed with the two sides of the ratchet main body opposite to each other so that the ratchet main body is non-rotatable relative to the head;

wherein the control assembly is movable toward or away from the head portion in an extension direction of the handle portion, the ratchet mechanism further includes a driving head and a quick release unit, the driving head is co-rotatably disposed on the ratchet main body, the driving head is for being inserted into a socket, the quick release unit includes a pushing member and a linkage assembly, the pushing member is movably disposed between the driving member and the linkage assembly, the linkage assembly is disposed through the driving head and movable between a releasing position and a positioning position, the linkage assembly is normally in the positioning position for engagement with the socket, when the linkage assembly is in the releasing position, the linkage assembly is disengaged with the socket, and when the control assembly moves toward the head portion, the driving member moves toward the ratchet main body to push the pushing member to move, and the pushing member actuates the linkage assembly to move from the positioning position to the releasing position; and wherein in the extension direction of the handle portion, one of the handle portion and the switch member has an embedding portion, the other of the handle portion and the switch member has three rabbets, and the three rabbets respectively correspond to the first, second and third positions; when the control assembly moves toward the head portion on the extension direction of the handle portion, the embedding portion is embedded within one of the three rabbets, and the control assembly is non-rotatable relative to the handle portion.

2. The ratchet wrench of claim 1, further including a first elastic member, one of two ends of the first elastic member abutting against the main body unit, the other of the two ends of the first elastic member abutting against the control assembly to bias the control assembly to move away from the head portion, the driving member being normally non-abutted against the pushing member.

3. The ratchet wrench of claim 1:

wherein the linkage assembly includes a roller, a linkage and a positioning ball which are arranged along the axis, the roller is positioned on one of two ends of the linkage, the other end of the two ends of the linkage has a receiving slot, and the positioning ball is movably received in the receiving slot and projectable beyond the driving head to be embedded into a positioning hole of the socket; the pushing member includes a pushing portion and a pushed portion, one of two ends of the pushing portion is laterally connected to the pushed portion, the other of the two ends of the pushing portion includes a linear section and an inclined section, and the pushed portion is between the ratchet main body and the driving member; when the linkage assembly is in the positioning position, the roller is sandwiched between the linear section and the linkage, the inclined section laterally abuts against the roller, and the positioning ball projects beyond the driving head; when the pushing member is pushed by the driving member to move, the inclined section presses the roller, the roller slides downward along a surface of the inclined section, when the roller is relatively below the pushing portion, the positioning ball is non-projected beyond the driving head, and the linkage assembly is on the releasing position.

4. The ratchet wrench of claim 1:

wherein the pawl unit includes two claws and two second elastic members, one of two ends of each said claw is rotatably connected to the head portion, the other of the two ends of each said claw is meshable with the ratchet main body, each of two ends of each said second elastic member respectively abuts against and between one said claw and the head portion, and the two second elastic members enable the two claws to have a tendency to move toward each other to be meshed with the ratchet main body; the shaft, the driving member and the switch member are coaxially arranged, and the driving member is cam-shaped and disposed between the two claws.

5. The ratchet wrench of claim 1, further including a positioning mechanism, the positioning mechanism including an engaging assembly and three recesses, the three recesses respectively corresponding to the first, second and third positions, the engaging assembly being configured to be embedded within one of the three recesses in a lateral direction of the handle portion; wherein the engaging assembly is disposed on one of the switch member and the handle portion, and the three recesses are disposed on the other of the switch member and the handle portion.

6. The ratchet wrench of claim 1, wherein the head portion includes a first face and a second face which is opposite to the first face, the first face has an input opening, the ratchet mechanism enters the interior of the head portion through the input opening, and the second face is a structure which has an intact surface.

7. The ratchet wrench of claim 3, wherein the ratchet wrench further includes a first elastic member, one of two ends of the first elastic member abutting against the main body unit, the other of the two ends of the first elastic member abutting against the control assembly to bias the control assembly to move away from the head portion, the driving member being normally non-abutted against the pushing member; the pawl unit includes two claws and two second elastic members, one of two ends of each said claw is rotatably connected to the head portion, the other of the two ends of each said claw is meshable with the ratchet main body, each of two ends of each said second elastic member respectively abuts against and between one said claw and the head portion, and the two second elastic members enable the two claws to have a tendency to move toward each other to be meshed with the ratchet main body; the shaft, the driving member and the switch member are coaxially arranged, and the driving member is cam-shaped and disposed between the two claws; the ratchet wrench further includes a positioning mechanism, the positioning mechanism includes an engaging assembly and three recesses, the three recesses respectively correspond to the first, second and third positions, the engaging assembly is configured to be embedded within one of the three recesses in a lateral direction of the handle portion; the three recesses are disposed on the handle portion and the engaging assembly is disposed on the switch member; the head portion includes a first face and a second face which is opposite to the first face, the first face has an input opening, the ratchet mechanism enters the interior of the head portion through the input opening, and the second face is a structure which has an intact surface; the first elastic member is sleeved on the shaft; the switch member and the driving member are respectively detachably assembled to the shaft; the engaging assembly includes a third elastic member and a restricting ball, the third elastic member is radially engaged with the switch member, and the restricting ball is arranged on one of two ends of the third elastic member; the handle portion includes a first component and a second component, the first component and the head portion are integrally formed, the second component covers at least one part of the first component, the second component has the three rabbets and the three recesses which communicate with each other, and the three rabbets respectively correspond to the three recesses; the first component and the head portion are made of metal, and the second component is made of plastic; the shaft has a circumferential slot, a positioning pin is positioned on the handle portion and penetrates through a side of the circumferential slot, the shaft is rotatable relative to the positioning pin, the shaft is moveable relative to the positioning pin along the handle portion, and in the extension direction of the handle portion, the positioning pin interferes with a side wall of the circumferential slot; the three recesses respectively extend toward the head portion along the extension direction of the handle portion.

* * * * *